US005692398A

United States Patent [19]

Higginbotham

[11] Patent Number: 5,692,398

[45] Date of Patent: Dec. 2, 1997

[54] PRODUCTION OF ARGON

[75] Inventor: Paul Higginbotham, Guildford, England

[73] Assignee: The BOC Group plc, Windlesham, England

[21] Appl. No.: 673,971

[22] Filed: Jul. 1, 1996

[30] Foreign Application Priority Data

Jul. 6, 1995 [GB] United Kingdom ..... 9513765

[51] Int. Cl.[6] ..... F25J 3/04

[52] U.S. Cl. ..... 62/648; 62/924

[58] Field of Search ..... 62/648, 924

[56] References Cited

U.S. PATENT DOCUMENTS

| | | | |
|---|---|---|---|
| 4,983,194 | 1/1991 | Hopkins et al. | 62/924 X |
| 5,161,380 | 11/1992 | Cheung | 62/924 X |
| 5,426,946 | 6/1995 | Corduan et al. | 62/924 X |
| 5,505,051 | 4/1996 | Darredeau et al. | 62/924 X |
| 5,572,874 | 11/1996 | Rathbone | 62/924 X |

*Primary Examiner*—Christopher Kilner

[57] ABSTRACT

A first stream of argon-enriched oxygen is separated in a first rectification column to form oxygen vapour further enriched in argon and a second stream of argon-enriched oxygen is introduced into a second rectification column operating at a lower pressure than the first rectification column. A vapour flow upwardly through the second rectification column is created by reboiling in a reboiler-condenser liquid separated therein. The further-enriched oxygen vapour is condensed in the reboiler-condenser by indirect heat exchange with said separated liquid. One stream of the condensed further-enriched oxygen vapour is employed as reflux in the first rectification column. A third argon-enriched oxygen stream is introduced in liquid state into an intermediate mass exchange region of the second rectification column. An argon product is separated in the second rectification column. The argon concentration of the third stream is greater than that of the second stream but less than that of the argon product, and the third stream is taken from the condensed further-enriched oxygen vapour or from other liquid in the first rectification column.

18 Claims, 4 Drawing Sheets

PRODUCTION OF ARGON

BACKGROUND OF THE INVENTION

This invention relates to a method and apparatus for producing argon.

Argon is typically produced commercially by the rectification of air. In a typical air rectification process there are performed the preliminary steps of compressing a stream of air, purifying the resulting stream of compressed air by removing water vapour and carbon dioxide from it, and precooling the stream of compressed air by indirect heat exchange with returning product streams to a temperature suitable for its rectification. The rectification is typically performed in a so-called "double rectification column" comprising a higher pressure rectification column and a lower pressure rectification column operating at different pressures from one another. Most of the incoming air is introduced into the higher pressure column and is separated into oxygen-rich liquid air and a nitrogen vapour. The nitrogen vapour is condensed. Part of the condensate is used as liquid reflux in the higher pressure column. Oxygen-enriched liquid is withdrawn from the bottom of the higher pressure column and is used to form a feed stream to the lower pressure column. The oxygen-enriched liquid air is separated into substantially pure oxygen and nitrogen in the lower pressure rectification column. Gaseous oxygen and nitrogen product are taken from the lower pressure rectification column and form the returning streams against which the incoming air is heat exchanged. Liquid reflux to the lower pressure rectification column is provided by taking a part of the aforesaid liquid nitrogen condensate and introducing it into the top of the lower pressure rectification column. An upward flow of vapour through the lower pressure rectification column from its bottom is created by reboiling liquid oxygen separated therein. The reboiling is carried out by indirectly heat exchanging the liquid oxygen with the nitrogen vapour separated in the higher pressure, the liquid nitrogen condensate thereby being formed.

A local maximum concentration of argon is created at an intermediate level of the lower pressure rectification column beneath that at which the oxygen-enriched liquid air is introduced.

In order to produce an argon product, a stream of argon-enriched oxygen vapour is taken from a region of the lower pressure rectification column where the argon concentration is typically in the range of 5 to 15% by volume of argon, and is introduced into a bottom region of a further rectification column in which an argon product is separated therefrom. The reflux for the argon column is provided by a condenser at the head of the column. This condenser is cooled by at least part of the oxygen-enriched liquid air upstream of the introduction of such liquid air into the lower pressure rectification column.

Such a process for producing argon is described in EP-A-0 377 117. Since argon and oxygen have similar volatilities to one another, the argon rectification column is designed with a large number of theoretical plates. For example, as described in EP-A-0 377 117, 180 theoretical trays may be used in a packed argon rectification column in order to produce an oxygen-free argon product directly from the argon rectification column. If desired, in order to reduce the height of the installation, the argon column can be split into two parts. Such an arrangement is shown in EP-A-0 628 777.

For a given size or capacity of this rectification column, the reflux ratio determines the rate at which argon can be produced at a given purity and recovery. In practice, there is an optimum range of reflux ratios which may be employed in the argon rectification column so as to maximise the recovery without adversely affecting the purity.

It is an aim of the present invention to provide a method and apparatus for producing argon which are able to improve the oxygen-argon separation by making possible effective use of lower reflux ratios in argon rectification than have hitherto been optimal in the argon rectification columns described in the prior patent specifications referred to hereinabove.

SUMMARY OF THE INVENTION

According to the present invention there is provided a method of producing argon, comprising separating from a first stream of argon-enriched oxygen in a first rectification column oxygen vapour further enriched in argon; introducing a second stream of argon-enriched oxygen into a second rectification column operating at a lower pressure than the first rectification column; creating a vapour flow upwardly through the second rectification column by reboiling liquid separated therein; condensing the further-enriched oxygen vapour by indirect heat exchange with said separated liquid and thereby effecting said reboiling; employing one stream of the condensed further-enriched oxygen vapour as reflux in the first rectification column; introducing a third argon-enriched oxygen stream in liquid state into an intermediate mass exchange region of the second rectification column, and separating an argon product in the second rectification column, wherein the argon concentration of the said third stream is greater than that of the second stream but less than that of the argon product, and the third stream is taken from the condensed further-enriched oxygen vapour or from other liquid in the first rectification column.

The invention also provides apparatus for producing argon comprising a first higher pressure rectification column, for separating oxygen vapour further enriched in argon from a first stream of argon-enriched oxygen, having an inlet for said first stream; a second lower pressure rectification column, for separating an argon product from a second stream of argon-enriched oxygen, having an inlet for said second stream; a reboiler-condenser having in heat exchange relationship with passages for condensing the further-enriched vapour, passages for reboiling liquid separated in the second rectification column, the reboiling passages having an outlet communicating with the second rectification column so as to enable upward flow of vapour through the second rectification column to be created, and the condensing passages having an outlet communicating with the first rectification column so as to enable reflux to be provided to the first rectification column; an inlet to an intermediate mass exchange region of the second rectification column communicating with the outlet of the said condensing passages or with an outlet for liquid from the first rectification column; and an outlet for product argon from the second rectification column.

The term "rectification column" as used herein, means a distillation or fractionation column, zone or zones, i.e. a contacting column zone or zones wherein liquid and vapour phases are countercurrently contacted to effect separation of a mixture, as for example, by contacting the vapour and liquid phases on packing elements or on a series of vertically spaced trays or plates mounted within the column zone or zones.

By the term "argon-enriched oxygen" as used herein is meant a mixture comprising argon and oxygen whose argon concentration is greater than the concentration of argon in air, i.e. greater than 0.93% by volume.

In terms of a McCabe-Thiele analysis, the method and apparatus according to the invention make it possible optimally to operate the second rectification column in a region extending from the level at which the third argon-enriched oxygen stream is introduced to its top along an operating line which has a less pronounced slope than is optimal when operating a conventional argon production process of the kind described hereinabove. The introduction of the third stream of argon-enriched oxygen to the second rectification column tends to create a pinch point at a higher argon concentration than in a conventional process, and it is in consequence of this pinch point that the slope of the operating line thereabove is decreased. One or more of a number of consequential advantages may be obtained. In particular, it is possible to increase the specific argon recovery, that is to say the yield of argon per unit power consumed. Thus either the argon recovery can be increased in comparison with a comparable conventional process without changing the overall power consumption or, there may be no increase in argon recovery but the overall power consumption may be reduced.

In order to keep to a minimum the optimum slope of the operating line in that region of the second rectification column above the level at which the third stream of argon-enriched oxygen vapour is introduced, it is preferred that the third stream is or has the same composition as the condensed further-enriched oxygen vapour and thus it is preferred not to take the third stream from an intermediate mass exchange region of the first rectification column. Preferably, the first rectification column has a pressure in the range of 1.3 to 1.5 bar at its top. If a pressure above this range is employed, a lesser degree of argon-oxygen separation takes place in the first rectification column and there are typically adverse effects on the operation of a main distillation column from which the first stream of argon-enriched oxygen is taken. If the pressure at the top of the first rectification column is below the above-stated range, it typically becomes necessary to operate the second rectification column at a pressure below 1 bar at its top if the advantages of the invention are to be obtained. Such low pressure operation of the second rectification column is, however, to be avoided.

Preferably, the third stream of argon-enriched oxygen contains from 15 to 30% by volume of argon. Such an argon concentration can readily be achieved if the pressure at the top of the first rectification column is maintained within the above-mentioned range.

The second stream of argon-enriched oxygen is preferably introduced in liquid state into the second rectification column, and the argon concentration of the separated liquid is preferably less than that at the second stream.

The said separated liquid preferably has an oxygen concentration of greater than 99% by volume and an argon concentration of less than 1% by volume.

The first stream of argon-enriched oxygen is preferably introduced in vapour state into the first rectification column. If it is introduced in liquid state, the first rectification column is provided with a reboiler in order to create an upward flow of vapour therethrough.

In some examples of the method according to the present invention, the second stream of argon-enriched oxygen is taken as a liquid from a bottom region of the first rectification column. In other examples, the second stream is taken as liquid from an intermediate mass exchange region of the first rectification column. The latter examples make it possible to include in the first rectification column beneath the intermediate mass exchange region thereof a lowermost liquid-vapour contact section in which impurities less volatile than oxygen are absorbed from the first stream of argon-enriched oxygen. It thus becomes possible to withdraw at least one oxygen product essentially free of methane (and other impurities less volatile than oxygen) from the second rectification column. The ability to produce such a high purity oxygen product is a further advantage of the method and apparatus according to the invention.

The first stream of argon-enriched oxygen is preferably taken in vapour state from a main rectification column in which air is separated. The main rectification column is preferably a double column, although if desired a single column may be employed in the manner shown in GB-A-1 258 568.

Argon vapour is preferably taken from a top mass exchange region of the second rectification column, is condensed, and one stream of the condensed argon vapour is taken as the argon product and another stream of the condensed argon vapour is employed as reflux in the second rectification column. If the main rectification column is a double column, the said argon vapour is preferably condensed by indirect heat exchange with a stream of oxygen-enriched liquid air withdrawn from the main column, and resulting vaporised oxygen-enriched liquid air is returned to the main column. In one alternative arrangement, a stream of oxygen-enriched liquid air from the double column is partially reboiled and thereby further enriched in oxygen. A stream of this further-enriched liquid is employed to condense said argon vapour by heat exchange. The partial reboiling is preferably performed by indirect heat exchange with nitrogen separated in the main rectification column. An advantage of such arrangements is that they enable liquid nitrogen reflux to be generated for use in the main rectification column at an enhanced rate. Such additional reflux can be used to improve the operation of the main rectification column and also to enhance argon recovery.

Vapour from the reboiling of the oxygen-enriched liquid air is preferably separated in a further rectification column operating at a pressure intermediate the operating pressure at the top of the higher pressure rectification column that forms part of the double column and the operating pressure at the top of the lower pressure rectification column that also forms part of the double column.

If the second stream of oxygen enriched in argon is taken from the bottom of the first rectification column, this column preferably contains from 5 to 10 theoretical trays. If the first rectification column additionally includes a lowermost methane absorption section and the second stream of argon-enriched oxygen is taken from above the lowermost section, up to an additional 5 theoretical trays are preferably employed in the first rectification column.

If it is desired to produce an oxygen-free argon product, the second rectification column preferably contains at least 220 theoretical trays. If desired, the second rectification column may comprise two separate zones housed in separate vessels. In such an arrangement relatively pure argon is produced in a second zone and the first stream of argon-enriched oxygen is fed to the first zone. Liquid from the bottom of the second zone is pumped to the top of the first zone and vapour is conducted from the top of the first zone to the bottom of the second zone. The arrangement of such a split second rectification column is thus analogous to that of the two argon columns shown in the drawing accompanying EP-A-0 628 777.

BRIEF DESCRIPTION OF THE DRAWINGS

The method and apparatus according to the invention will now be described by way of example with reference to the accompanying drawings, in which.

The drawings are not to scale. Like parts in FIGS. 1 and 3 are indicated by the same reference numerals.

DETAILED DESCRIPTION

Figure 1:
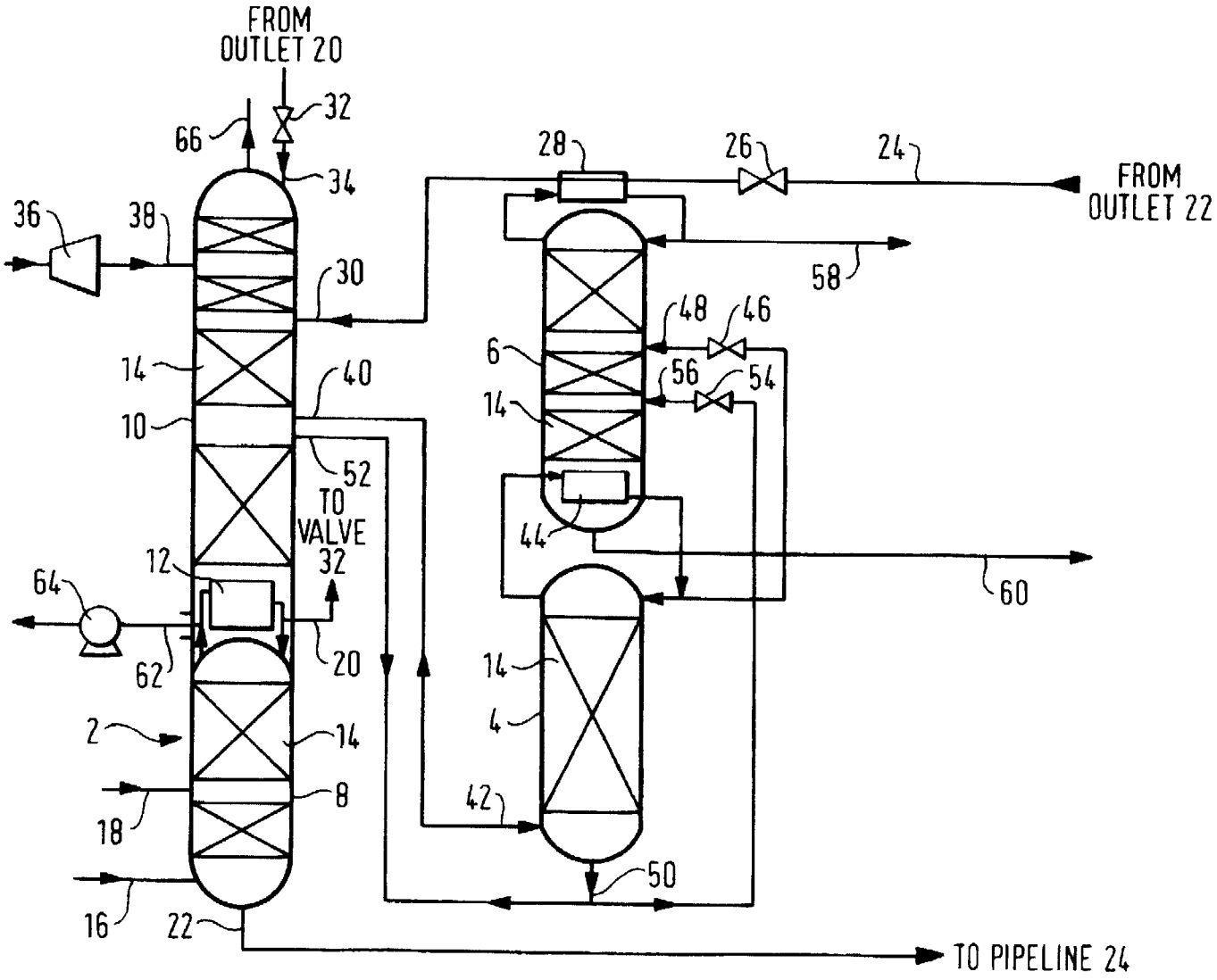
FIG. 1 is a schematic flow diagram of an arrangement of rectification columns.

Referring to FIG. 1 of the drawings, there is shown an arrangement of rectification columns comprising a main rectification column 2, a first rectification column 4 for separating a stream of vaporous argon-enriched oxygen taken from the main rectification column 2, and a second rectification column 6 for separating a second argon-enriched oxygen stream. The main rectification column 2 takes the form of a double rectification column comprising a higher pressure rectification column 8 and a lower pressure rectification column 10. The top of the higher pressure rectification column 8 is linked thermally in a conventional manner to the bottom of the lower pressure rectification column 10 by a condenser-reboiler 12. In each of the rectification columns 4, 6, 8 and 10 mass exchange takes place between an ascending vapour phase and a descending liquid phase. As a result of mass exchange, the vapour phase becomes progressively richer in a more volatile component in its direction of ascent while the liquid phase becomes progressively richer in a less volatile component in its direction of descent. Contact between the liquid and vapour phases takes place on liquid-vapour contact surfaces provided by liquid-vapour contact devices 14 which may comprise sieve trays, random or structured packing, or a combination of such devices. Random or structured packing is preferably used in the columns 4, 6 and 10. A downward flow of liquid through each column is created by introducing a liquid reflux stream into the top of the column and allowing it to flow downwardly therethrough. A reboiler is used to provide an upward vapour flow through any rectification column which is fed only with streams in the liquid state for separation. A dry, carbon dioxide free, vaporous air stream is introduced at a chosen elevated pressure and at its dew point, or a temperature just above the dew point, into the higher pressure rectification column 8 through an inlet 16. In addition, a dry, carbon dioxide-free, liquid air stream is introduced through an inlet 18 to the higher pressure rectification column 8 at a level above that of the inlet 16. The air is separated in the higher pressure rectification column 8 into a nitrogen vapour fraction at its top and an oxygen-enriched liquid air fraction at its bottom. The nitrogen vapour is condensed in the condenser-reboiler 12 by indirect heat exchange with boiling oxygen. A part of the liquid nitrogen condensate is returned to the top of the higher pressure rectification column 8 as reflux. Another part is withdrawn through an outlet 20 and is employed as liquid nitrogen reflux in the lower pressure rectification column 10. An oxygen-enriched liquid air stream is withdrawn from the bottom of the higher pressure rectification column 8 through an outlet 22. If desired, the oxygen-enriched liquid air stream may be sub-cooled (by means not shown) and may form the feed to a pipeline 24. The pipeline 24 has a pressure reducing valve 26 in it whereby the pressure of the oxygen-enriched liquid air stream is reduced to a little above the operating pressure of the lower pressure rectification column 10. The pressure-reduced oxygen-enriched liquid air flows through a condenser 28 associated with the top of the second rectification column 6 and is partially vaporised by indirect heat exchange with condensing argon. The partially vaporised oxygen-enriched liquid air is introduced into the lower pressure rectification column 10 through an inlet 30. Liquid nitrogen reflux taken from the outlet 20, and, if desired, sub-cooled (by means not shown), is passed through a pressure reducing valve 32, and is introduced into the top of the lower pressure rectification column 10 through an inlet 34. If desired, a further dry, carbon dioxide-free, air stream at a temperature at or a little above its dew point is introduced into the lower pressure rectification column 10 from a turbine 36. The further air stream enters the column 10 via an inlet 38 which is located at or above the level of the inlet 30 but below that of the inlet 34.

The air streams are separated in the lower pressure rectification column 10 into a nitrogen vapour fraction at the top of the column 10 and a liquid oxygen fraction at the bottom of the column 10. The liquid oxygen fraction provides the source of the liquid that is employed to condense the nitrogen in the reboiler-condenser 12. As a result, oxygen is vaporised and the vapour flows upwardly through the lower pressure rectification column 10.

In the lower pressure rectification column 10, there is formed a region below the inlet 30 but above the bottom of the column 10 where the argon concentration is at least several times that of the incoming air. A first argon-enriched oxygen vapour stream typically containing from 8 to 12% by volume of argon (the balance being oxygen apart from trace impurities) is withdrawn through an outlet 40 and is introduced into the bottom of the first rectification column 4 below the level of the liquid-vapour contact devices 14 located therein. The bottom of the first rectification column 4 thus operates at the same pressure as that at the outlet 40 from the lower pressure rectification column 10. The argon-enriched oxygen vapour is separated in the first rectification column 4 into an oxygen fraction further enriched in argon at its top and a crude argon-containing liquid oxygen fraction at its bottom. Typically, the further-enriched oxygen fraction contains from 15 to 25% by volume of argon. A stream of the further-enriched oxygen fraction is withdrawn from the first rectification column 4 and is condensed by indirect heat exchange with boiling oxygen. A part of the resulting condensate is returned to the top of the first rectification column 4 and provides reflux for that column. That part of the condensed oxygen fraction further enriched in argon which is not employed as reflux in the first rectification column 4 is passed through a pressure reducing valve 46 and is introduced into the lower pressure rectification column 6 as a third argon-enriched oxygen stream through an inlet 48 at an intermediate level above that of the inlet 56.

A second stream of argon-enriched oxygen in liquid state is withdrawn from the first rectification column 4 through the outlet 50, is passed through a pressure reducing valve 54, and is introduced into the second rectification column 6 through an inlet 56 at an intermediate level above the bottom of the second rectification column 6. Some liquid-vapour contact devices 14 are located between the bottom of the column 6 and the level of the inlet 56. Another stream of argon-enriched liquid oxygen is withdrawn from the bottom of the first rectification column 4 through an outlet 50 and is returned via an inlet 52 to approximately the same level of the lower pressure rectification column 10 as that at which the outlet 40 is located.

The argon-enriched oxygen streams that are introduced into the second rectification column 6 through the inlets 48 and 56 are separated therein into an argon vapour fraction at its top and a liquid oxygen fraction at its bottom. A stream of the argon fraction flows through the condenser 28 and effects the partial reboiling of the oxygen-enriched liquid stream therein. As a result, the argon fraction is condensed. Part of the condensate is returned to the second rectification column 6 and provides reflux therein. The remainder of the condensed argon is taken as product through an outlet 58. A part of the liquid oxygen fraction is reboiled at the bottom of the rectification column 6 by indirect heat exchange with the condensing further enriched oxygen. The remainder of the liquid oxygen fraction is taken as product via an outlet 60. In addition an oxygen product is withdrawn from the bottom of the lower pressure rectification column 10 through an outlet 62 by a pump 64. In addition, a nitrogen product is withdrawn in vapour state through an outlet 66 from the top of the lower pressure rectification column 10.

The second rectification column 6 is operated at a lower pressure than the first rectification column 4. The pressure at the top of the second rectification column 6 is typically a little above 1 bar, for example 1.1 bar. The oxygen product withdrawn via the outlet 60 preferably contains less than 0.1% by volume of impurities. The number of theoretical trays with which the second rectification column is designed and hence the actual height of packing employed therein may be selected so as to give an essentially oxygen-free argon product. The pressure at the bottom of the second rectification column 6 is equal to the sum of the pressure at the top thereof and the total pressure drop through the column. The pressure at the bottom of the second rectification column 6 determines the temperature at which the oxygen fraction boils. This in turn determines the temperature at which the further-enriched oxygen condenses in the condenser-reboiler 44. The composition of the further enriched oxygen is thus arranged to be that which gives the necessary condensing temperature. In one typical example, the pressure at the top of the second rectification column 6 is 1.1 bar and that at the bottom of the first rectification column 4 is 1.4 bar. With such pressures, the further-enriched oxygen fraction typically contains about 20% by volume of argon. Typically, the first rectification column 4 is designed with sufficient packing to provide from 5 to 10 theoretical trays. In order to produce an oxygen-free argon fraction at its top the second rectification column 6 may be designed with about 240 theoretical trays. It is desirable that the liquid-vapour contact devices 14 employed in the rectification columns 4 and 6 have a low pressure drop per theoretical tray. Preferably, therefore, a low pressure drop structured packing or low pressure drop random packing is employed therein.

Figure 2:
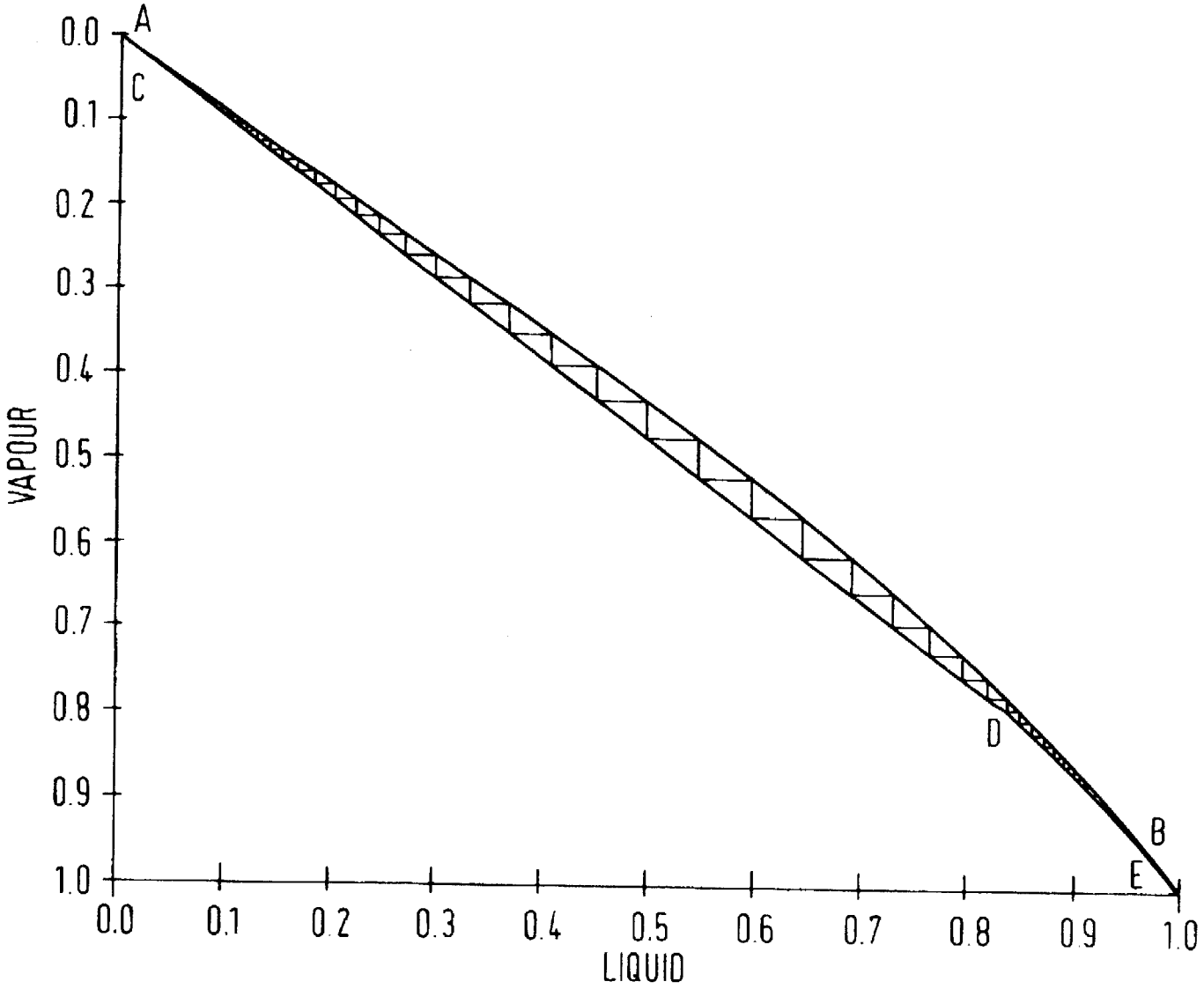
FIG. 2 is a schematic McCabe-Thiele diagram illustrating operation of one of the rectification columns shown in FIG. 1.

The introduction of the liquid oxygen stream further enriched in argon into the second rectification column 6 has a profound influence on its operation. This influence is illustrated in FIG. 2. FIG. 2 is a McCabe-Thiele diagram representing operation of the second rectification column 6. FIG. 2 shows the equilibrium line AB and the operating line CDE of the column 6. The point D represents the composition of the mixture being separated at the level at which the third argon-enriched oxygen stream is introduced through the inlet 48. The slope of the part CD of the line CDE is less than what it would be were no liquid to be introduced into the second rectification column 6 through the inlet 48. In consequence, the section of the column 6 above the level of the inlet 48 can be operated at a lower reflux ratio than when no such liquid is introduced. As a result, the flow of the oxygen-rich liquid air through the condenser 28 associated with the top of the second rectification column 6 may similarly be less. Thus, a smaller proportion of the oxygen-enriched liquid air withdrawn from the higher pressure rectification column 10 is vaporised in the condenser 28 with the result that the reflux ratio in the section of the rectification column 10 between the inlet 30 and the outlet 40 is increased. As a result, the concentration of argon in the argon-enriched oxygen vapour withdrawn through the outlet 40 is enhanced with the overall result that less argon is discharged from the process in the oxygen product and the argon recovery is increased. Alternatively, a greater proportion of the incoming air can be introduced into the main distillation column 2 from the expansion turbine 36. On the assumption that useful work can be recovered from the turbine 36, for example, in driving a booster-compressor (not shown) which is used to raise the pressure of the incoming air, the result is that the amount of argon produced per unit of net power consumed in the process is reduced, i.e. there is a power saving. If desired, a combination of the advantages of improved argon recovery and reduced power consumption can be achieved.

Another advantage that arises from the method illustrated by FIG. 1 is that owing to the reduced reflux ratio above the level of the inlet 48, the vapour traffic thereabove is reduced and therefore notwithstanding the extra theoretical stages less packing is required. Indeed, the total amount of packing employed in the rectification columns 4 and 6 is typically less than that of a conventional single argon column that gives an argon product of the same purity.

Figure 3:
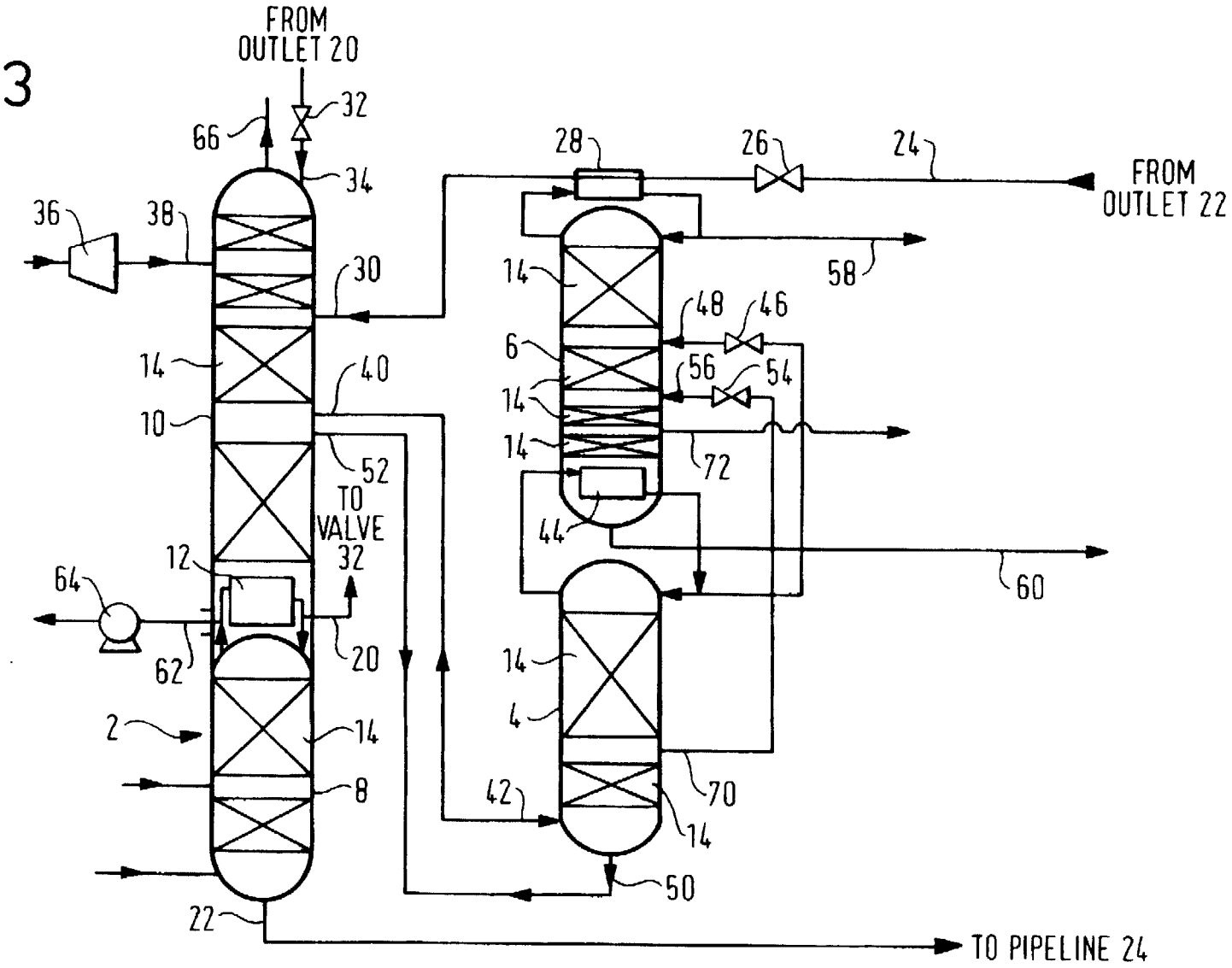
FIG. 3 illustrates a modification to the arrangement of columns shown in FIG. 1.

Referring to FIG. 3 of the drawings, there is shown a modified arrangement of columns whereby an oxygen product of particularly high purity may be taken from the second rectification column 6. In the arrangement shown in FIG. 3 the second argon-enriched oxygen stream is taken from the first rectification column 4 from an outlet 70 at an intermediate level of the column 4. Typically there is in the first rectification column 4 an amount of packing 14 beneath the level of the outlet 70 sufficient to ensure that the second argon-enriched oxygen stream and hence the product oxygen from the second rectification column 6 contains less than 10 parts per billion (1 billion equals 1,000,000,000) of impurities less volatile than oxygen, such impurities typically principally comprising krypton, xenon, methane and hydrocarbons heavier than methane. Typically, by withdrawing the second argon-enriched oxygen stream from an intermediate level of the rectification column 4, the reflux ratio in the section of the column 4 beneath the level of the outlet 70 is reduced to below the minimum reflux necessary for argon-oxygen separation. Accordingly, separation of the more volatile impurities, particularly methane, krypton and xenon, takes place in a section of the rectification column 4 below the level of the outlet 70. This separation takes place relatively readily since the difference in the volatility of each of these impurities and that of oxygen is substantially greater than the difference between volatilities of argon and oxygen. Accordingly, the height (i.e. the vertical extent) of packing employed below the level of the outlet 70 is typically less than that employed above.

In addition to withdrawing a very high purity liquid oxygen product from the second rectification column 6 through the outlet 60, it is preferred to withdraw a high purity oxygen product stream from a level of the second rectification column 6 a few theoretical trays above the bottom of the column 6 but below the inlet 56. In consequence, the liquid/vapour ratio below the level of the outlet 72 is close to one and as a result fewer theoretical trays are required in the section of the second rectification column 6 below the level of the outlet 72.

Figure 4:
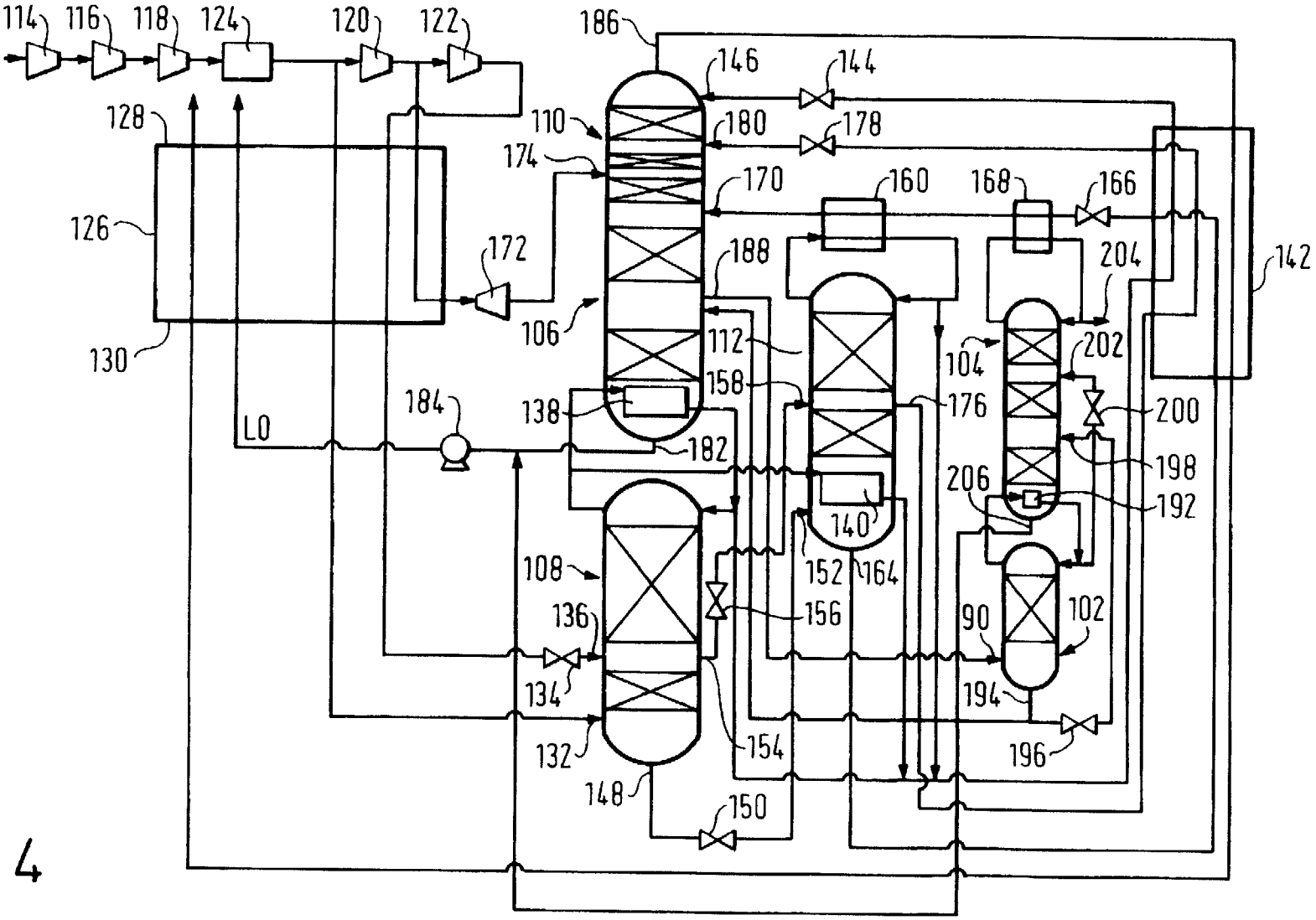
FIG. 4 is a schematic flow diagram of an air separation plant employing a yet further arrangement of rectification columns.

Referring now to FIG. 4 of the drawings, there is shown an air separation plant having an arrangement of rectification columns comprising a first rectification column 102 for separating an argon-oxygen mixture; a second rectification column 104 for separating an argon-oxygen mixture; a main rectification column 106 for separating air (which produces an argon-oxygen mixture for separation in the first and second rectification columns 102 and 104) comprising a higher pressure rectification column 108 and a lower pressure rectification column 110; and a yet further rectification column 112 which operates at a pressure less than that at the top of the higher pressure rectification column 108 and greater than that at the bottom of the lower pressure rectification column 110. This further rectification column 112 is referred to below as the intermediate pressure rectification column.

An air stream is drawn into the plant shown in FIG. 4 by operation of a train of compression stages 114, 116, 118, 120 and 122. Intermediate the compression stages 118 and 120, the compressed air flows through a purification unit 124 which removes by adsorptive separation relatively non-volatile impurities such as water vapour and carbon dioxide from the incoming air. The operation of such purification units is well known in the art.

A first stream of the purified, compressed, air is taken from intermediate the purification unit 124 and the inlet to the compression stage 120 and is passed through a main heat exchanger 126 from its warm end 128 to its cold end 130. The first stream of purified air is thereby cooled to a temperature a little above its dew point such that it is able to be separated by rectification. The cooled first air stream is introduced into the higher pressure rectification column 108 through an inlet 132 at its bottom. A second purified stream of compressed air is further compressed in the compression stage 120. The further compressed purified air flow is divided into two subsidiary streams. One of the subsidiary streams is compressed yet again in the compression stage 122 and is passed through the main heat exchanger 126 from its warm end 128 to its cold end 130. The first subsidiary air stream leaves the cold end 130 of the main heat exchanger 126 in liquid state or as a supercritical fluid. The thus cooled subsidiary air stream flows through a Joule-Thomson valve 134 and is introduced into the higher pressure rectification column 108 through an inlet 136 in essentially liquid state.

The air introduced into the higher pressure rectification column 108 is separated therein into oxygen-enriched liquid fraction at its bottom and a nitrogen vapour fraction at its top. A first stream of the nitrogen vapour fraction is condensed in a first condenser-reboiler 138 placing the top of the higher pressure rectification 108 in thermal communication with the bottom of the lower pressure rectification column 110. A part of the resulting liquid nitrogen condensate is returned to the top of the higher pressure rectification column 108 as reflux. A second stream of the nitrogen vapour fraction is condensed in a second condenser-reboiler 140 located in the bottom of the intermediate pressure rectification column 112. The second stream of the nitrogen vapour fraction is condensed in the second condenser-reboiler 140. The resulting condensate is mixed with that part of the condensate from the first condenser-reboiler 138 which is not returned to the top of the higher pressure rectification column 108. The resulting mixture flows through a heat exchanger 142 and is thereby sub-cooled. The sub-cooled liquid nitrogen flows through a Joule-Thomson valve 144 and is introduced through an inlet 146 into the top of the lower pressure rectification column 110.

A stream of the oxygen-enriched liquid air is withdrawn from the bottom of the higher pressure rectification column 108 through an outlet 148, is passed through a Joule-Thomson valve 150, and is introduced into the bottom of the further rectification column 112 where it is partially reboiled by indirect heat exchange with the condensing nitrogen vapour in the second-condenser reboiler 140. As a result, the liquid is further enriched in oxygen. A further stream of liquid air containing approximately 21% by volume of oxygen is withdrawn from the higher pressure rectification column 108 through an outlet 154, is passed through a Joule-Thomson valve 156, and is introduced into the intermediate pressure rectification column 112 through an inlet 158 at an intermediate level thereof.

Nitrogen vapour is separated from the air in the intermediate pressure rectification column 112. A stream of the nitrogen vapour is withdrawn from the top of the column 112 and is condensed in a condenser 160. A part of the condensate is returned to the top of the intermediate pressure rectification column 112 as reflux. Reboil for the intermediate pressure rectification column 112 is provided by operation of the second condenser-reboiler 140. That part of the liquid nitrogen condensate from the condenser 160 which is not returned to the intermediate pressure rectification column 112 is mixed with the liquid nitrogen condensate flowing from the condenser-reboilers 138 and 140 to the top of the lower pressure rectification column 110. The intermediate pressure rectification column 112 is able to enhance the rate at which liquid nitrogen reflux is supplied to the lower pressure rectification column 110, making possible increase in argon recovery and/or a reduction in the power consumption of the plant.

A stream of the liquid air further enriched in oxygen is withdrawn from the bottom of the intermediate pressure rectification column 112 through an outlet 164 and is sub-cooled by passage through the heat exchanger 142. The resulting sub-cooled liquid air stream flows through a Joule-Thomson valve 166 and is reduced in pressure thereby to a pressure a little above that at which the lower pressure rectification column 110 operates. The pressure-reduced liquid air stream further enriched in oxygen flows in sequence through a condenser 168 associated with the second rectification column 104, thereby being partly reboiled, and the condenser 160, in which its reboiling is completed. The resulting vaporised, further-enriched air stream is introduced into the lower pressure rectification column 110 through an inlet 170.

Other air streams are introduced into the lower pressure rectification column 110 in addition to that entering through the inlet 170. In particular, the aforesaid second subsidiary stream of air is taken from intermediate the compression stages 120 and 122 and is reduced in temperature by passage through the heat exchanger 126 from its warm end 128 to an intermediate region thereof. The thus-cooled second subsidiary air stream is withdrawn from the intermediate region of the main heat exchanger 126 and is expanded with the performance of work in an expansion turbine 172. The resulting expanded air at approximately its dew point enters the lower pressure rectification column 110 through an inlet 174 at a level at or above that of the inlet 170. A further air stream for introduction into the lower pressure rectification column 110 is formed by withdrawal of a liquid air stream from the intermediate pressure rectification column 112 through an outlet 176 at the same level as inlet 158.

The liquid air stream withdrawn through the outlet 176 is sub-cooled by passage through the heat exchanger 142 and is reduced in pressure by passage through a Joule-Thomson valve 178. The resulting liquid air stream is introduced into the lower pressure rectification column through an inlet 180 at a level above that at the inlet 174.

The air streams introduced into the lower pressure rectification column 110 are separated therein into a nitrogen vapour fraction at its top and a liquid oxygen fraction at its bottom. A part of the liquid oxygen is reboiled in the first condenser-reboiler 138, thereby providing necessary cooling for the condensing of the nitrogen vapour therein. A stream of oxygen product is withdrawn from the bottom of the lower pressure rectification column 110 through an outlet 182 in liquid state by operation of a pump 184. The liquid oxygen is thus pressurised. The pressurised liquid oxygen is vaporised by passage through the main heat exchanger 126 from its cold end 130 to its warm end 128. A pressurised, gaseous oxygen product is thereby formed. A nitrogen product stream is withdrawn from the top of the lower pressure rectification 110 through an outlet 186 and is warmed by passage through the heat exchangers 142 and 126 in sequence. Nitrogen product may be vented to the atmosphere or, for example, used as a blanketing gas in a process which requires essentially oxygen-free conditions.

A first argon-enriched vapour stream containing approximately 10% by volume of argon is withdrawn from an intermediate level of the lower pressure rectification column through an outlet 188. The first argon-enriched oxygen vapour stream is introduced into the bottom of the first rectification column 102 through an inlet 190. An oxygen vapour fraction containing about 20% by volume of argon is separated in the first rectification column 102. A stream of this oxygen fraction is condensed in a third condenser-reboiler 192. A part of the resulting condensate is returned to the first rectification column 102 as reflux. A second argon-enriched oxygen stream is withdrawn in liquid state from the bottom of the first rectification column 102 through an outlet 194 and is reduced in pressure by passage through a Joule-Thomson valve 196. The pressure-reduced second argon-enriched oxygen stream is introduced into the second rectification column 104 through an inlet 198 at a first intermediate level thereof. Another part of the condensate from the condenser-reboiler 192 is passed through another Joule-Thomson valve 200 and is introduced as a third argon-enriched oxygen stream into the second rectification column 104 through an inlet 202 at a second intermediate level thereof above the inlet 198. The stream is introduced into the second rectification column 104 and is separated therein into a liquid oxygen fraction at its bottom and a vaporous argon fraction at its top. A stream of the argon vapour is condensed in the condenser 168. A part of the resulting condensate is fed back to the second rectification column 104 as reflux. Another part of the condensed argon is taken as liquid argon product from an outlet 204. A liquid oxygen product stream is withdrawn from the bottom of the rectification column 104 through an outlet 206 and is combined with the liquid oxygen product from the lower pressure rectification column 110.

Typically, the higher pressure rectification column 108 operates at a pressure of about 5.7 bar at its top, the lower pressure rectification column 110 at a pressure of about 1.3 bar at its top, the intermediate pressure rectification column 112 at a pressure of about 3 bar at its top, the first rectification column 102 at a pressure of about 1.4 bar at its bottom, and the second rectification column 104 at a pressure of about 1.1 bar at its top.

In comparison with a conventional argon column, the arrangement of the first and second rectification columns 102 and 104 has a reduced demand for condensation in the condenser 168. As a result, it becomes possible to operate the intermediate pressure rectification column 112 and its condenser 160 so as to enhance the liquid nitrogen reflux available to the lower pressure rectification column 110. Accordingly, the separation of argon from oxygen in the lower pressure rectification column 110 can be enhanced with the result that both the overall oxygen recovery and argon recovery of the method can be increased in comparison with those of a comparable conventional plant.

I claim:

1. A method of producing argon comprising separating from a first stream of argon-enriched oxygen in a first rectification column oxygen vapour further enriched in argon;

introducing a second stream of argon-enriched oxygen into a second rectification column operating at a lower pressure than the first rectification column;

creating a vapour flow upwardly through the second rectification column by reboiling liquid separated therein; condensing the further-enriched oxygen vapour by indirect heat exchange with said separated liquid and thereby effecting said reboiling;

employing one stream of the condensed further-enriched oxygen vapour as reflux in the first rectification column;

introducing a third argon-enriched oxygen stream in liquid state into an intermediate mass exchange region of the second rectification column and separating an argon product in the second rectification column;

the argon concentration of the said third stream being greater than that of the second stream but less than that of the argon product and the third stream being taken from the condensed further-enriched oxygen vapour or from other liquid in the first rectification column.

2. The method as claimed in claim 1, wherein the first rectification column has a pressure in the range of about 1.3 and about 1.5 bar at its top.

3. The method as claimed in claim 1, in which the third stream of argon-enriched oxygen contains from about 15 to about about 30% by volume of argon.

4. The method as claimed in claim 1, in which the second stream of argon-enriched oxygen is introduced in liquid state into the second rectification column and the argon concentration of the said separated liquid is less than that of the second stream.

5. The method as claimed in claim 1, in which the separated liquid has an oxygen concentration of greater than about 99% by volume and an argon concentration of less than about 1% by volume.

6. The method as claimed in claim 1, in which the first stream of argon-enriched oxygen is introduced in vapour state into the first rectification column.

7. The method as claimed in claim 1, in which the second stream of argon-enriched oxygen is taken as a liquid from a bottom region of the first rectification column.

8. The method as claimed in claim 1, in which the second stream of argon-enriched oxygen is taken as liquid from an intermediate mass exchange region of the first rectification column.

9. The method as claimed in claim 8, in which the first rectification column has a lowermost liquid-vapour contact section in which impurities less volatile than oxygen are absorbed from the first stream of argon-enriched oxygen.

10. The method as claimed in claim 1, in which the first stream of argon-enriched oxygen is taken in vapour state from a main rectification column in which air is separated.

11. The method as claimed in claim 10, in which argon vapour is taken from a top mass exchange region of a second rectification column and condensed, and one stream of the condensed argon vapour is taken as argon product and another stream of the condensed argon vapour is employed as reflux in the second rectification column.

12. The method as claimed in claim 11, in which the main rectification column is a double column and the said argon vapour is condensed by indirect heat exchange with a stream of oxygen-enriched liquid air withdrawn from the main column, and resulting vaporised oxygen-enriched liquid air is returned to the main column.

13. The method as claimed in claim 11, in which a stream of oxygen-enriched liquid air from the double column is partially reboiled and thereby further enriched in oxygen, and a stream of the liquid further enriched in oxygen is employed to condense said argon vapour by indirect heat exchange, the partial reboiling is performed by indirect heat exchange with nitrogen separated in the main rectification column, and vapour from the reboiling of the oxygen-enriched liquid air is separated in a further rectification column operating at a pressure intermediate the operating pressure at the top of the higher pressure rectification column that forms part of the double column and the operating pressure at the top of the lower pressure rectification column that also forms part of the double column.

14. An apparatus for producing argon comprising:

a first higher pressure rectification column for separating oxygen vapour further enriched in argon from a first stream of argon-enriched oxygen, the first higher pressure column having an inlet for said first stream;

a second lower pressure rectification column for separating an argon product from a second stream of argon-enriched oxygen, the second lower pressure rectification column having an inlet for said second stream;

a reboiler-condenser having in heat exchange relationship with condensing passages for condensing the further-enriched vapour, reboiling passages for reboiling liquid separated in the second rectification column;

the reboiling passages having an outlet communicating with the second rectification column so as to enable an upward flow of vapour through the second rectification column to be created;

the condensing passages having an outlet communicating with the first rectification column so as to enable reflux to be provided to the first rectification column;

an inlet to an intermediate mass exchange region of the second rectification column communicating with one of the outlet of the said condensing passages and an outlet for liquid from the first rectification column; and an outlet for product argon from the second rectification column.

15. The apparatus as claimed in claim 14, in which the said inlet to the second rectification column communicates with a bottom region of the first rectification column.

16. The apparatus as claimed in claim 14, in which the said inlet to the second rectification column communicates with an intermediate mass exchange region of the first rectification column.

17. The apparatus as claimed in claim 16, in which the first rectification column includes a lowermost section for absorbing relatively non-volatile impurities from oxygen.

18. The apparatus as claimed in claim 14, in which the said inlet to the first rectification column communicates with a main rectification column for separating air.

* * * * *